United States Patent [19]

Mizuno et al.

[11] Patent Number: 4,968,979

[45] Date of Patent: Nov. 6, 1990

[54] VEHICLE DETECTING SYSTEM

[75] Inventors: Masao Mizuno, Kyoto; Toshihiko Maruo, Otsu; Takuya Fujimoto, Kyoto; Seiichi Sawada; Kenji Kanayama, both of Nagaokakyo, all of Japan

[73] Assignee: Omron Tateisi Electronics Co., Kyoto, Japan

[21] Appl. No.: 320,799

[22] Filed: Mar. 9, 1989

Related U.S. Application Data

[60] Continuation of Ser. No. 180,586, Apr. 7, 1988, abandoned, which is a division of Ser. No. 853,698, Apr. 18, 1986, abandoned.

[30] Foreign Application Priority Data

| | | | |
|---|---|---|---|
| Jun. 7, 1985 | [JP] | Japan | 60-124865 |
| Sep. 9, 1985 | [JP] | Japan | 60-199039 |
| Sep. 10, 1985 | [JP] | Japan | 60-201188 |
| Apr. 19, 1986 | [JP] | Japan | 60-84855 |

[51] Int. Cl.[5] ..... G08G 1/01

[52] U.S. Cl. ..... 340/941; 340/933

[58] Field of Search ..... 340/904, 933, 941, 943, 340/988, 989, 551, 573; 191/10

[56] References Cited

U.S. PATENT DOCUMENTS

| | | | |
|---|---|---|---|
| 2,201,145 | 5/1940 | Barker | 340/551 |
| 2,532,231 | 11/1950 | Jarvis | 340/551 |
| 3,644,825 | 2/1972 | Davis, Jr. et al. | 340/941 |
| 3,675,195 | 7/1972 | Iwamoto et al. | 340/941 |
| 3,911,389 | 12/1975 | Mills | 340/941 |
| 3,943,339 | 3/1976 | Koerner et al. | 340/941 |
| 4,075,553 | 2/1978 | Bouverot et al. | 340/941 |
| 4,232,285 | 11/1980 | Narbaits-Jaureguy et al. | 340/941 |
| 4,276,539 | 6/1981 | Eshraghian et al. | 340/941 |

FOREIGN PATENT DOCUMENTS

| | | | |
|---|---|---|---|
| 2433241 | 1/1976 | Fed. Rep. of Germany | 340/941 |
| 1346415 | 11/1963 | France . | |
| 627053 | 7/1949 | United Kingdom . | |

OTHER PUBLICATIONS

"Future Vehicle Detection Concepts", IEEE Transactions on Vehicular Technology vol. VT 19, No. 1, Feb. 1970, Milton K. Mills.

Search Report, The Hague, 01-19-1989, EP 86105498.

*Primary Examiner*—Joseph A. Orsino

*Assistant Examiner*—Brent A. Swarthout

*Attorney, Agent, or Firm*—Dickstein, Shapiro & Morin

[57] ABSTRACT

A vehicle detecting system for detecting the number of vehicles which pass the roadway, thereby realizing the smooth flow of vehicles. This system comprises: a transmitting coil and a receiving coil which are arranged on both sides of the vehicle detection area set over the roadway; a driving circuit to supply a high frequency exciting current to the transmitting coil; and vehicle detecting circuit to output a vehicle detection signal in response to a change in level or phase of the electrical signal which is induced in the receiving coil. The detection signal is outputted when the signal level exceeds a predetermined value or when the signal phase exceeds a predetermined angle. One or a plurality of pairs of transmitting and receiving coils may be buried under the roadway surface or on above the roadway at regular intervals. With this system, the installing construction of the coils is simplified and the possibility of the occurrence of the accident such as disconnection of the coil is reduced. The vehicle on the roadway can be certainly detected.

10 Claims, 17 Drawing Sheets

VEHICLE DETECTING SYSTEM

This application is a continuing application of Ser. No. 180,586, filed Apr. 7, 1988, which is a divisional application of Ser. No. 853,698, filed Apr. 18, 1986, both now abandoned.

BACKGROUND OF THE INVENTION

1. Field of the Invention

The present invention relates to a vehicle detecting system to detect the existence, passage, and the like of a vehicle. This system is used in a traffic control system to smooth the traffic flow by, for example, counting the number of vehicles which pass a predetermined place on the road and controlling the signals on the basis of the count number obtained.

2. Description of the Prior Art

As typical of conventional vehicle detecting systems, there has been known a system including an almost square loop coil buried under the road surface. A high frequency exciting current flows through the loop coil. When the vehicle passes above the loop coil, the inductance of the coil changes, so that the value of the current also varies. The passage of the vehicle can be recognized by detecting the change in this current.

However, such a conventional vehicle detecting system has the following problems.

In general, the loop coil has the size of about 2 m×2 m and the road must be dug up over a wide range to bury such a large loop coil into the road. Such a burying construction is large-scaled, so that the construction expenses increase and much labor is needed for the construction.

The loop coil buried under the road surface is frequently subjected to the loads in association with the passages of vehicles, so that the disconnection of the coil is likely to occur. The occurrence of the disconnection disenables the detection of vehicles.

SUMMARY OF THE INVENTION

It is an object of the present invention to simplify the construction for installing the vehicle detecting system represented by the burying construction and also suppress the occurrence of the disconnection while keeping the vehicle detecting sensitivity to a relatively high level.

A vehicle detecting system according to the present invention comprises: a transmitting coil arranged on one side of a predetermined detection area set on the roadway of vehicles and a receiving coil arranged on the opposite side of the transmitting coil; a driving circuit to supply a high frequency exciting current to the transmitting coil; and vehicle detecting means for outputting a vehicle detection signal in response to a change over a predetermined amount in the characteristic of an electrical signal which is induced in the receiving coil. The characteristic of the electrical signal includes the level of the signal, phase of the signal, and the like.

The term "roadway" mentioned above denotes all of the locations where vehicles run and has the concept which apparently includes not only the ordinary road but also the road, floor and the like in factories or precincts. The terms "vehicle" and "vehicles" also have the wide meaning including not only what are called four-wheeled automobiles but also tricycle type automobiles, two-wheeled type vehicles, bicycles, unmanned automobiles, travelling robot, and the like. The transmitting and receiving coils may be buried under the roadway surface or may be set at positions of predetermind height above the roadway. The detection area is the virtual area and is actually determined by the positions where the transmitting and receiving coils are arranged. One side and the other side of the detection area do not necessarily coincide with one side and the other side of the roadway. The transmitting and receiving coils may be provided at two positions along the running direction of the vehicle or may be provided at two positions which are away from each other at a predetermined distance in the direction perpendicular to the running direction of the vehicle. Further, those coils may be obliquely arranged with respect to those directions.

In the vehicle detecting system according to the invention, in the case of detecting the vehicle on the basis of the variation in level of the signal which is induced in the receiving coil, the following actions are obtained. Namely, when the high frequency exciting current flows through the transmitting coil, the high frequency magnetic field is developed between the transmitting and receiving coils. When the vehicle passes in the magnetic field, the mutual inductance of both coils changes and the level of the electrical signal which is induced in the receiving coil changes. This reception signal is inputted to the vehicle detecting circuit (vehicle detecting means). When the change in the level of the reception signal is a predetermined amount or more, the vehicle detection signal is outputted from the vehicle detecting circuit.

The sizes of transmitting and receiving coils are extremely smaller than the conventional loop coil. Therefore, even when these coils are buried in the roadway, the burying construction can be simplified as compared with the conventional one. In addition, it is not always necessary to bury the transmitting and receiving coils to detect the vehicle but these coils may be also installed on the roadway. In this case, the installing construction can be further simplified.

In the case where the driving circuit and vehicle detecting circuit are enclosed in a box and this box is arranged on one side of the roadway, it is sufficient to bury one of the transmitting and receiving coils, e.g., the transmitting coil on this side and to bury the other coil, e.g., the receiving coil on the other side of the roadway or in the central portion thereof, or the like. In this case, although the signal line connecting the receiving coil and vehicle detecting circuit must be buried so as to cross the roadway, it is sufficient to dig up the roadway along only a signal line. In the case where the driving circuit and transmitting coil are arranged on one side of the roadway and the receiving coil and vehicle detecting circuit are arranged on the other side, respectively, there is no need to arrange the signal line so as to cross the roadway.

Further, in the case of providing the transmiting and receiving coils above the roadway, it is unnecessary to dig up the roadway.

Consequently, the possibility of the occurrence of the disconnection decreases as compared with the conventional system in which the whole large loop coil is buried in the roadway.

Moreover, the space between the transmitting and receiving coils becomes the vehicle detection, area and this detection area can be set to a wide region. Therefore, the deterioration of the sensitivity as compared with that of the conventional loop coil is not caused.

BRIEF DESCRIPTION OF THE DRAWINGS

FIGS. 15 to 20 show further another embodiment, in which:

FIG. 15 shows the state in which a plurality of pairs of transmitters and receivers are arranged along the vehicle roadway;

FIG. 16 is a block diagram showing an arrangement of the transmitter;

FIG. 17 is a block diagram showing an arrangement of the receiver;

FIG. 18 is a block diagram showing an electrical arrangement of the vehicle detecting system;

FIG. 19 is a waveform diagram showing the relations among the designation signal, the driving of the transmitters, and the reception in the receivers; and FIG. 20 is a waveform diagram showing the relations among the driving of the transmitters, the reception in the receivers, and the vehicle detection signals.

DESCRIPTION OF THE PREFERRED EMBODIMENTS

Figure 1:
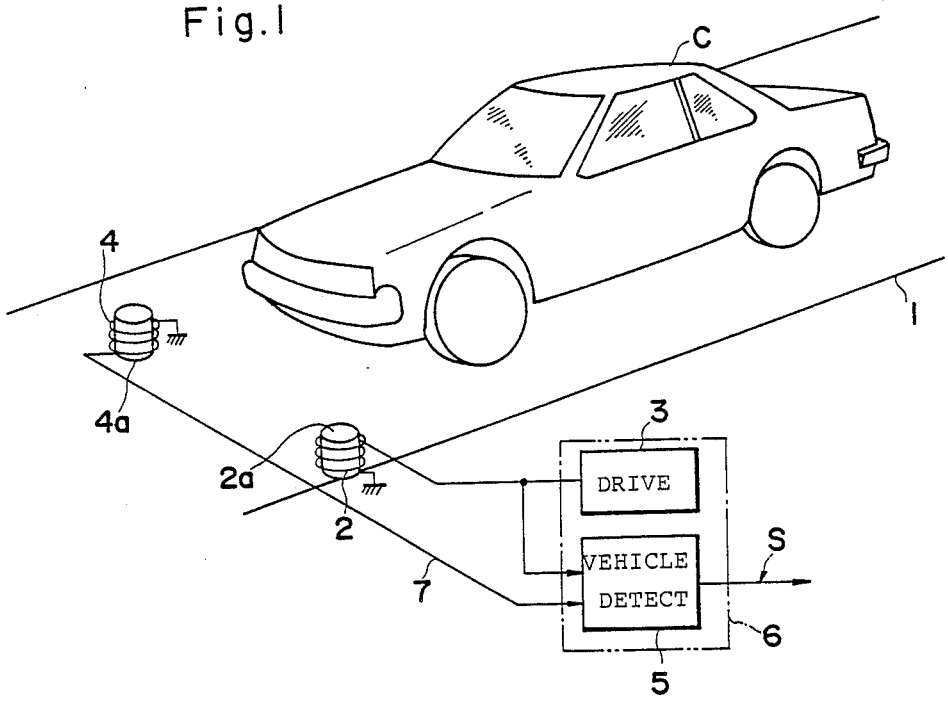
FIG. 1 shows an arrangement of a transmitting coil and a receiving coil.

FIG. 1 shows an example of an arrangement of a transmitting coil 2 and a receiving coil 4. The coils 2 and 4 are wound around magnetic cores 2*a* and 4*a*, respectively, and buried on both sides in the lateral direction of a roadway (e.g., one lane of the road). The sizes of cores 2*a* and 4*a* are relatively small; for example, the length is about 70 mm and the diameter is about 15 mm. The cores 2*a* and 4*a* are arranged so that their longitudinal directions are the vertical direction. The distance between the transmitting coil 2 and the receiving coil 4 may be set to an arbitrary value and it will be ordinarily about one to several meters. The area between the coils 2 and 4 substantially serves as the vehicle detection area. Therefore, the vehicle detection area may be set to an arbitrary range and at an arbitrary location in accordance with the position where the coils 2 and 4 are arranged.

Either one of or both of the transmitting coil 2 and receiving coil 4 may be arranged on the roadway surface or may be also installed above the roadway surface (for example, at the position of height of about five meters) by a pole brace or the like which is vertically set on the roadway. Both coils 2 and 4 may be provided on one side of the roadway 1.

A high frequency exciting current is supplied from a driving circuit 3 to the transmitting coil 2. The frequency of this exciting current may be set to have a value in a range of about tens to hundreds of kHz. This frequency assumes $f_0$.

The voltage or current which is induced in the receiving coil 4 by the high frequency electromagnetic field (mainly, the magnetic field) which is generated from the transmitting coil 2 is given to a vehicle detecting circuit 5 through a line 7 buried under the surface of the roadway 1. The detecting circuit 5 detects in principle a change over a predetermined level in a reception signal of the receiving coil 4 and outputs a vehicle detection signal S. In the arrangement shown in FIG. 1, the detecting circuit 5 always compares the level (or phase) of the signal from the driving circuit 3, namely, the level (or phase) of the current which is outputted to the transmitting coil 2 with the level (or phase) of the current which is inputted from the receiving coil 4. When the difference between those levels (or phases) is over or below a predetermined value, the detecting circuit 5 outputs the vehicle detection signal S. The driving circuit 3 and vehicle detecting circuit 5 are enclosed in a box 6 and this box is installed on the side or above the roadway 1. The vehicle detection signal S is transmitted to a central controlling unit (not shown) through a telephone line or another communication line or a transmitting line which is particularly installed. The central controlling unit controls the flow of all vehicles in the whole range covered by the unit on the, basis of the vehicle detection signals transmitted.

Figure 2A:
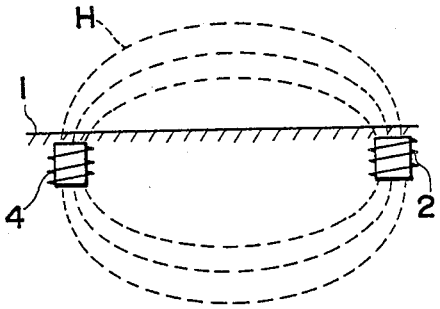
FIGS. 2*a* and 2*b* are diagrams for explaining the vehicle detecting operation.

When the high frequency exciting current flows through the transmitting coil 2 from the driving circuit 3, the high frequency magnetic field H is developed between the transmitting coil 2 and the receiving coil 4. As shown in FIG. 2*a*, when a vehicle C doesn't exist in the magnetic field H, there is no change in the level difference (or phase difference) between the transmitting current (exciting current) which is inputted to the detecting circuit 5 and the received current which is obtained in the receiving coil 4, so that the vehicle detection signal S is not outputted.

Figure 2B:
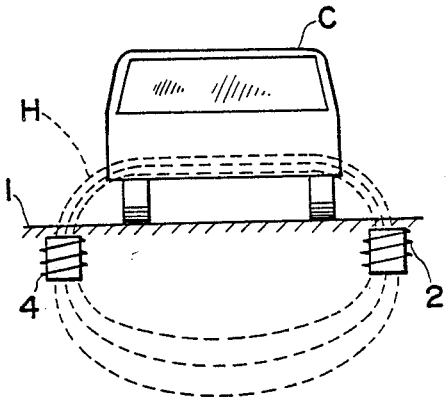

As shown in FIG. 2*b*, on the contrary, when the vehicle C passes in the magnetic field H, the magnetic fluxes are concentrated to the metallic portions of the vehicle C, so that the mutual inductance of the transmitting coil 2 and receiving coils 4 changes.

There are two cases: where the magnetic resistance between the coils 2 and 4 decreases in dependence on the material of the vehicle body or the height of vehicle, so that the received current increases (in the case where the vehicle body is made of iron); and where the received current decreases due to the eddy-current loss (in the case where the vehicle body is made of aluminum). In any of these cases, this current change is detected by the detecting circuit 5. Namely, since the received current changes but the transmitting current is constant, the vehicle detection signal S is outputted from the detecting circuit 5.

Figure 3:
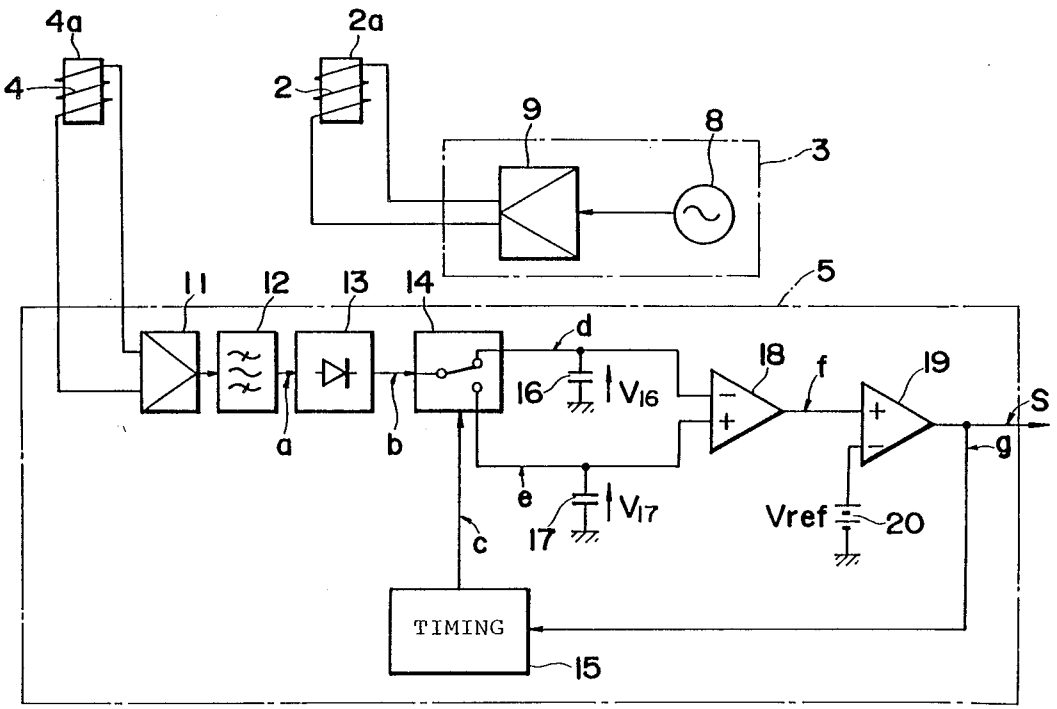
FIG. 3 is a block diagram showing an electrical arrangement of an embodiment of the present invention.
Figure 4:
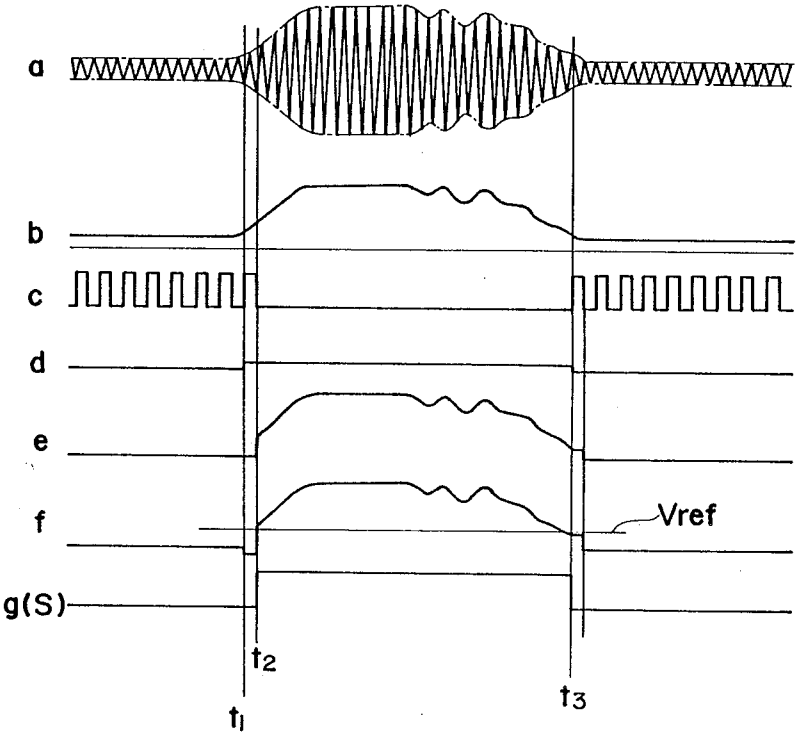
FIG. 4 shows output signal waveforms in the block diagram of FIG. 3.

FIG. 3 shows an example of a more practical arrangemnt of the driving circuit 3 and vehicle detecting circuit 5 shown in FIG. 1. In this diagram, the same parts and components as those shown in FIG. 1 are dsignated by the same reference numerals. FIG. 4 shows typical output signal waveforms in the circuit block shown in FIG. 3.

In FIG. 3, the driving circuit 3 of the transmitting coil 2 comprises a high frequency oscillating circuit 8 and a power amplifier 9 to amplify an oscillating output of the oscillator 8 and gives it to the transmitting coil 2. In this example, the output current of the driving circuit 3 is not supplied to the detecting circuit 5.

The signal induced in the receiving coil 4 is amplified by an amplifier 11 and thereafter its noise component is removed by a band pass filter 12 having a center frequency of $f_0$. An output signal a of the filter 12 is detected by a detecting circuit 13 and becomes a signal b.

The signal b is sent to an analog switching circuit 14. The first output side of the switching circuit 14 is grounded through a capacitor 16 and the second output side is grounded through a capacitor 17. Electrostatic capacitances of the capacitors 16 and 17 are equal. Positive terminals of the capacitors 16 and 17 are connected to the input terminals of a differential amplifier 18, respectively. An output terminal of the differential amplifier 18 is connected to one input terminal of a comparator 19. A constant voltage power supply 20 to generate a threshold voltage Vref is connected to the other input terminal of the comparator 19. An output signal of the comparator 19 becomes the vehicle detection signal S. As mentioned above, the detection signal S is transmitted to an external apparatus, e.g., the central controlling unit (not shown) and also supplied to a timing curcuit 15 (as a signal g). When the ouput signal g of the comparator 19 is at a low level "L", the timing circuit 15 outputs a pulse signal (a train of pulses) c to the switching circuit 14. When the output signal g of the comparator 19 is at a high level "H" (i.e., when the vehicle is detected), the timing circuit 15 stops the generation of the pulse signal c.

The switching circuit 14 connects the detecting circuit 13 to the capacitor 16 when the pulse signal c from the timing circuit 15 is at an "H" level. The switching circuit 14 connects the detecting circuit 13 to the capacitor 17 when the pulse signal c is at an "L" level.

The switching circuit 14, differential amplifier 18, capacitors 16 and 17 connected therebetween, and timing circuit 15 serve to detect the time-dependent change in the signal which is induced in the receiving coil 4 and operate in the following manner.

Since the vehicle detection signal S is at an "L" level until time $t_1$ shown in FIG. 4, a series of pulses c are generated from the timing circuit 15. Therefore, the switching circuit 14 repeatedly performs the switching operation. Since the signal b of the same level is alternately supplied to the capacitors 16 and 17, charged voltages $V_{16}$ and $V_{17}$ of the capacitors 16 and 17 are equal and an output signal f of the differential amplifier 18 is at the zero level. The output signal g of the comparator 19 is held at an "L" level.

When the vehicle C enters the magnetic field H at time $t_1$, the level of the output signal b of the detecting circuit 13 starts increasing. Assuming that the pulse signal c rise at time $t_1$, the detecting circuit 13 is connected to the capacitor 16. The level of the input signal d of the capacitor 16 increases by only an amount commensurate with the increased amount of the signal b. Thus, the output signal f of the differential amplifier 18 is slightly reduced.

When the pulse signal c trails at time $t_2$, the detecting circuit 13 is connected to the capacitor 17. Since the level of the output signal b of the detecting circuit 13 increases for the period of time between times $t_1$ and $t_2$, the level of the input signal e to the capacitor 17 largely increases. Thus, the level of the output signal f of the differential amplifier 18 exceeds the threshold voltage Vref and the output signal g of the comparator 19 becomes an "H" level. Due to this, the vehicle detection signal S at an "H" level is outputted and at the same time, the output signal g is inputted to the timing circuit 15. The generation of the pulse signal c from the timing circuit 15 is stopped. Thus, the switching operation of the switching circuit 14 is stopped at time $t_2$. The connecting state of the detecting circuit 13 with the capacitor 17 is held.

In other words, the charged voltage $V_{16}$ of the capacitor 16 is held constant and at the same time, the level of the input signal e to the capacitor 17, namely, the charged voltage $V_{17}$ of the capacitor 17 changes in accordance with the level change of the output signal b of the detecting circuit 13. In addition, the level of the output signal f of the differential amplifier 18 also similarly changes. Such a state continues for the period of time until the vehicle C has passed through the magnetic field H.

When the vehicle C has passed through the magnetic field H and the level of the output signal b of the detecting circuit 13 decreases and at the same time, when the level of the output signal f of the differential amplifier 18 becomes lower than the threshold voltage Vref at time $t_3$ in response to the reduction of the level of the signal b, the generation of the vehicle detection signal S stops (i.e., the detection signal S becomes an "L" level) and the output signal g of the comparator 19 also becomes an "L" level. Thus, the pulse signal c is sent from the timing circuit 15 to the switching circuit 14. The switching operation is restarted and the system is returned to the inherent switching state.

The above embodiment can be applied to only the case where the signal level of the receiving coil 4 increases due to the existence of the vehicle C. However, if a window type comparator is substituted for the comparator 19, this system can be also applied to the case where the received signal level decreases due to the existence of the vehicle C.

Figure 5:
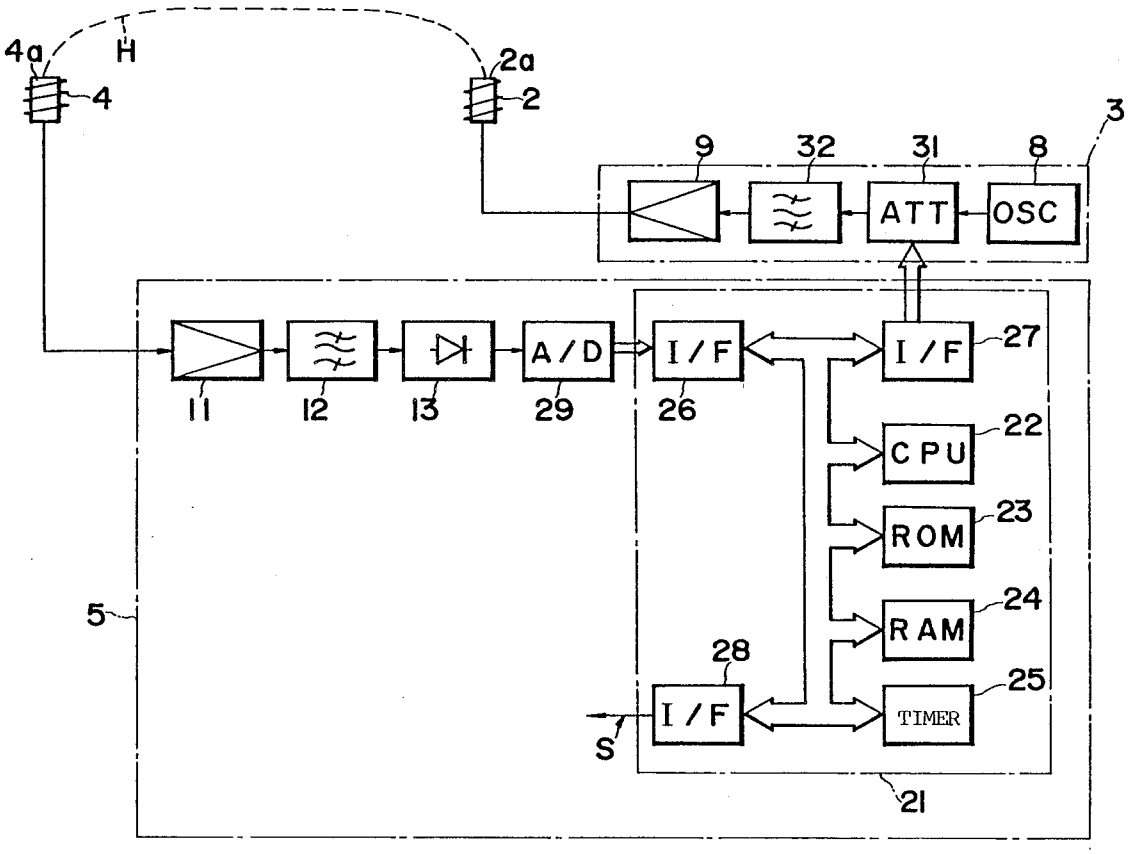
FIG. 5 is a block diagram showing an electrical arrangement of another embodiment of the present invention.
Figure 6:
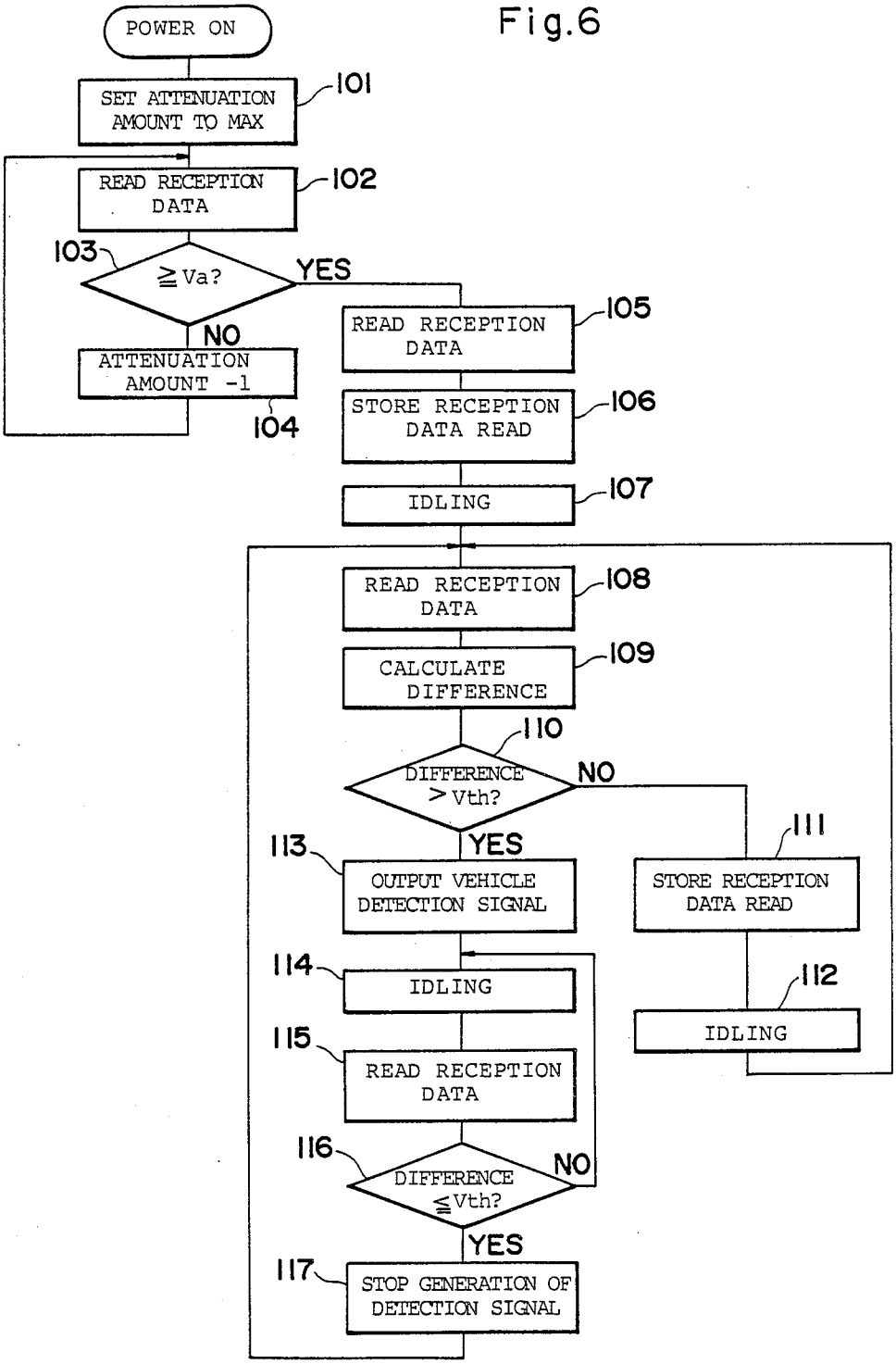
FIG. 6 is a flowchart showing the operation of the system shown in FIG. 5, particularly, the processing procedure by a CPU.
Figure 7:
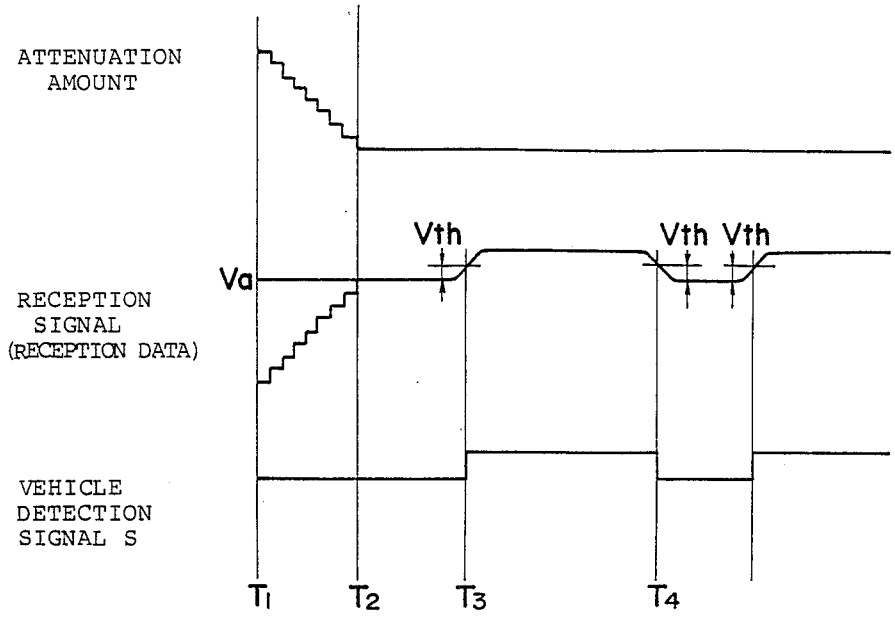
FIG. 7 is a time chart showing the time-dependent changes of the signals and values in the system shown in FIG. 5.

FIGS. 5 to 7 show another embodiment in which the vehicle detecting process is executed by use of a microprocessor.

FIG. 5 shows an electrical arrangement of a vehicle detecting system, in which the same parts and components as those shown in FIG. 3 are designated by the same reference numerals.

The driving circuit 3 is additionally provided with an attenuator 31 and a band pass filter 32. The oscillating output of the oscillator 8 is attenuated by the attenuator 31. Thereafter, the higher harmonic wave component is removed by the band pass filter 32. Thus, the signal having only the component of the frequency $f_0$ is sent to the power amplifier 9. An amount of attenuation of the attenuator 31 is controlled by a microprocessor 21, as will be explained hereinafter, in a manner such that the level of the received signal, which is induced in the receiving coil 4 when no vehicle is present, is always kept at a predetermined non-zero level.

After the received signal of the receiving coil 4 was detected by the detecting circuit 13, its level is converted into a digital value by an analog-to-digital (A/D) converter 29 and supplied to the microprocessor 21. The level of the received signal converted into the digital value is referred to as the reception data hereinafter.

The microprocessor 21 comprises: a central processing unit (CPU) 22 to perform the control of the attenuator 31 and the like as well as the vehicle detecting process; a read only memory (ROM) 23 in which the programs which are executed by the CPU 22 are stored; a random access memory (RAM) 24 to store a reference value Va of the received signal level (i.e., reception data), attenuation amount of the attenuator 31, level of the received signal, threshold value Vth for detection of the vehicle, etc.; a timer 25; an interface 26 to take in the received signal; an interface 27 to control the attenuator; and an interface 28 to output the vehicle detection signal S.

FIG. 6 shows a flowchart for the processing procedure by the CPU 22. FIG. 7 shows time-dependent changes of various kinds of signals and values, respectively.

Referring now to FIGS. 5 to 7, when the power supply is turned on at time $T_1$, the attenuation amount of the attenuator 31 is set to the maximum value. Namely, the value of the exciting current flowing through the transmitting coil 2 (i.e., transmission level) is minimized (step 101). The attenuation amount is stored into the RAM 24. Next, the reception data as the output value of the A/D converter 29 is supplied to the microprocessor 21 (step 102). This reception data is checked to see if it has reached the reference value Va corresponsing to a predetermined voltage which is required to detect the vehicle C or not (step 103). If NO, the attenuation amount of the attenuator 31 is set to the value which is lower by only one unit (step 104) and then step 102 follows again. By repeating the process in steps 102 to 104, the attenuation amount of the attenuator 31 is reduced in a stepwise manner, while the reception data increases step by step. The attenuation amount stored in the RAM 24 is updated each time the above process is repeated.

When the reception data becomes the reference value Va in time $T_2$ (namely, if YES in step 103), the reception data is again supplied from the A/D converter 29 (step 105) and stored into a predetermined reception data area of the RAM 24 (step 106). Next, the idling is carried out for a predetermined period of time in step 107. Namely, the system waits for a sampling period which is determined by the timer 25.

Thereafter, the reception data is further supplied (step 108) and the difference between this reception data and the precedent reception data which has been obtained one sampling before and which has been stored in the RAM 24 is calculated (step 109). A check is then made to see if the difference exceeds the vehicle detection threshold value Vth or not (step 110).

When the difference is less than the value Vth, the reception data supplied in step 108 is stored into the reception data area of the RAM 24 and the reception data is updated (step 111). This process is executed to cope with the time-dependent change in the level of the received signal. It is desirable to execute this updating process only in the case where the difference between the reception data supplied in step 105 and the present reception data supplied in step 108 is less than a predetermined value. Or, if the process in steps 101 to 106 is periodically executed when no vehicle exists, it is not always necessary to execute the updating, process in step 111. Thereafter, the idling is performed (step 112) and the processing routine is returned to step 108. In this manner, the process in step 108 to 112 is repeated.

When the vehicle C enters the detection area and the difference between the present reception data and the precedent reception data exceeds the threshold value Vth at time $T_3$ (i.e., if YES in step 110), the vehicle detection signal S is outputted through the interface 28 (step 113).

After completion of the idling (step 114), the reception data is taken in (step 115). The difference between this reception data and the reception data stored in the RAM 24 in step 106 or 111 is calculated and this difference is checked to see if it is below the threshold value Vth or not (step 116). If the difference still exceeds Vth, the process in steps 114 to 116 is repeated.

When the vehicle C has passed the detection area where the magnetic field H exists and the difference becomes smaller than the value Vth at time $T_4$, the generation of the vehicle detection signal S is stopped (step 117). Thereafter, step 108 follows again.

Figure 8:
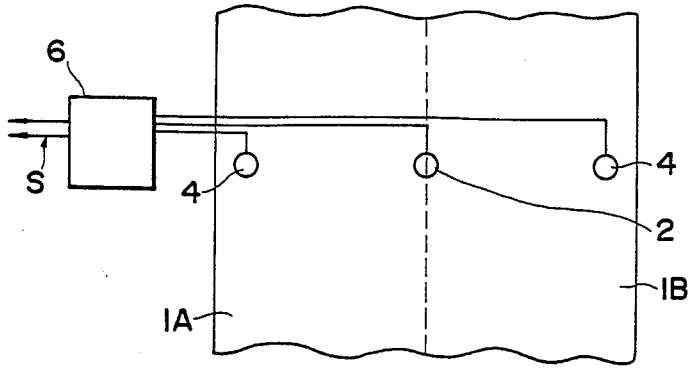
FIG. 8 shows another example of the arrangement of the transmitting and receiving coils.
Figure 9A:
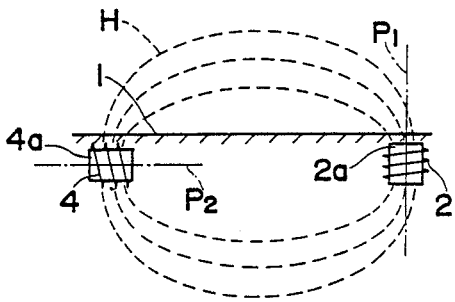
FIGS. 9*a* and 9*b* show still other examples of the arrangement of the transmitting and receiving coils.
Figure 9B:
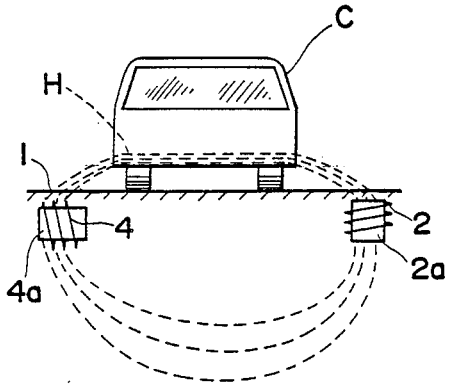

As shown in FIG. 8, in the case where two adjacent roadways are formed, the transmitting coil 2 is installed at the boundary portion of both roadways 1A and 1B and two receiving coils 4 are arranged on the outsides of the roadways 1A and 1B. In this way, the vehicle detecting system can be also constituted such that one transmitting coil 2 is commonly used to detect vehicles which pass two roadways, 1A and 1B.

In the foregoing embodiment, particularly, as shown in FIGS. **2*a* and 2*b*, the longitudinal directions, i.e., the axes of the cores 2*a* and 4*a* of the transmitting and receiving coils 2 and 4 are vertically arranged. In such an arrangement, even if the vehicle C dosn't exist as well, the number of magnetic fluxes which interlink the receiving coil 4 due to the magnetic field H which is formed between the coils 2 and 4 is relatively large. When the vehicle C passes in the detection area, the number of magnetic fluxes which interlink the receiving coil 4** increases. However, since this increase amount is not so large, the sensitivity for detection of vehicles is not so high.

As shown in FIGS. **9*a* and 9*b*, by vertically arranging an axis $P_1$ of the transmitting coil 2 and horizontally arranging an axis $P_2$ of the receiving coil 4**, the vehicle detecting sensitivity can be raised.

As shown in FIG. **9*a*, if no vehicle exists in the detection area, the number of magnetic fluxes of the magnetic field H which interlink the receiving coil 4** is extremely small.

When the vehicle C passes through the magnetic field H, on the other hand, the magnetic field H is bent as shown in FIG. **9*b* and the density of magnetic fluxes interlinking the receiving coil 4** increases and at the same time, the number of interlinking magnetic fluxes remarkably increases. Thus, the level of voltage which is induced in proportion to the change in number of interlinking magnetic fluxes also fairly increases as compared with the case of the arrangement shown in FIGS. 2*a* and 2*b* (namely, it is increased at least about ten to hundred times) and the vehicle detecting sensitivity is sufficiently improved.

To increase the vehicle detecing sensitivity, the following arrangement is preferable. Namely, briefly explaining, in the plane which is formed by the axis of the core of the transmitting coil 2 and the axis of the core of the receiving coil 4, it is sufficient to arrange the axis of the core 4*a* of the receiving coil 4 substantially perpendicularly with respect to the axis of the core 2*a* of the transmitting coil 2 or at an angle near it. Therefore, in the case where the axis of the core of the transmitting coil is vertically arranged and the axis of the core of the receiving coil is horizontally arranged, the sensitivity is improved. Also, in the case where the axis of the core of the transmitting coil is horizontally arranged and the axis of the core of the receiving coil is vertically arranged, or where both axes of the cores of the transmitting and receiving coils are obliquely arranged, or the like, the detecting sensitivity is improved.

Figure 10:
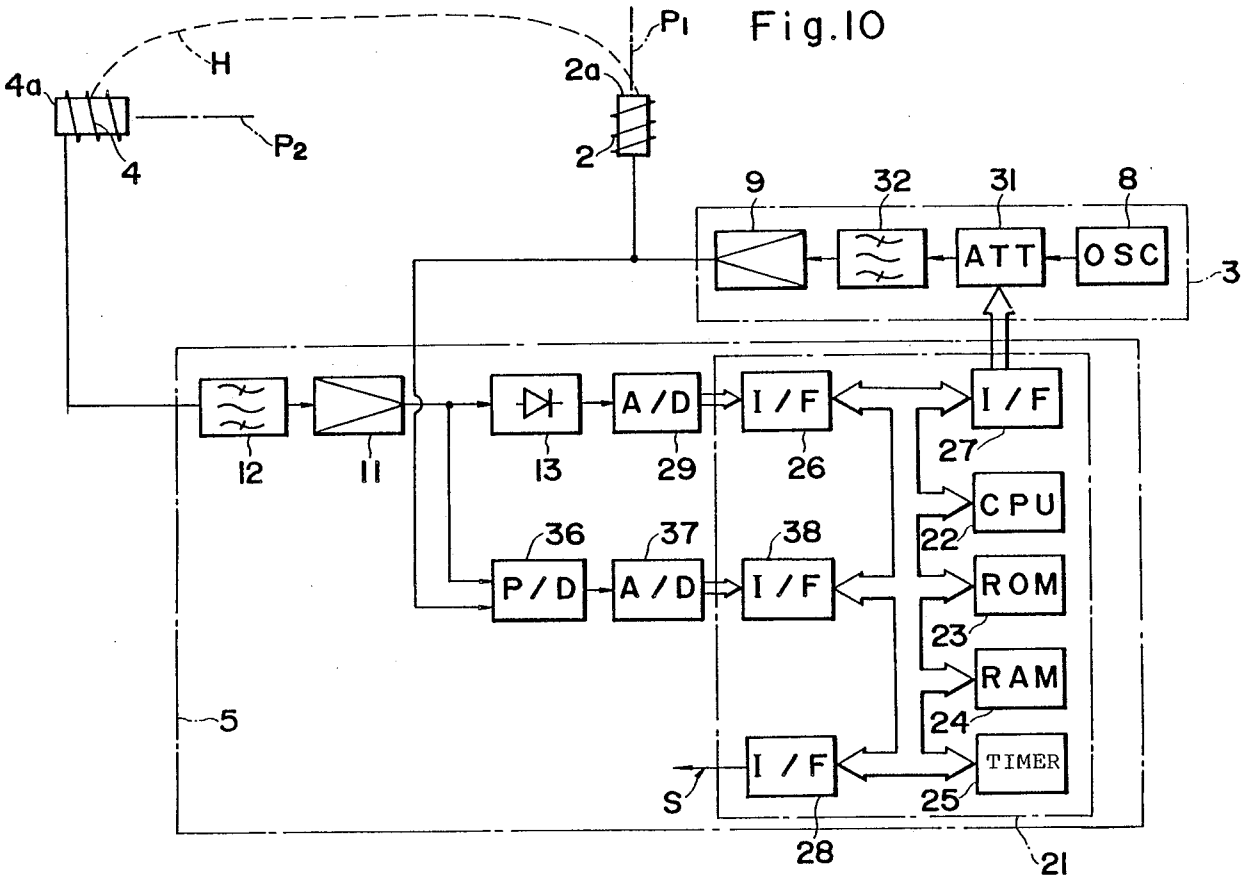
FIG. 10 is a block diagram showing an electrical arrangement of still another embodiment of the present invention.
Figure 11:
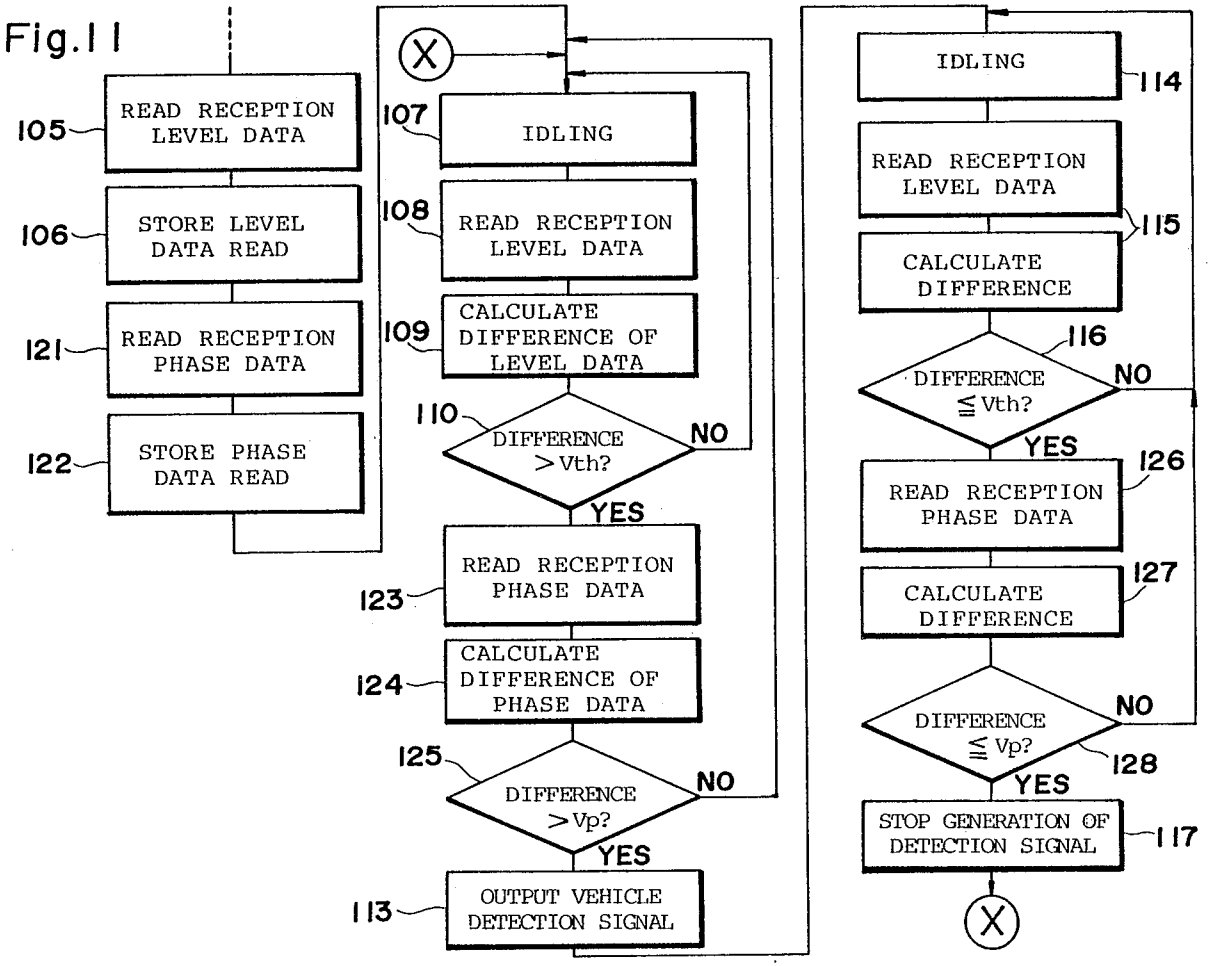
FIG. 11 is a flowchart showing the operation of the system shown in FIG. 10, particularly, the processing procedure by a CPU.
Figure 12:
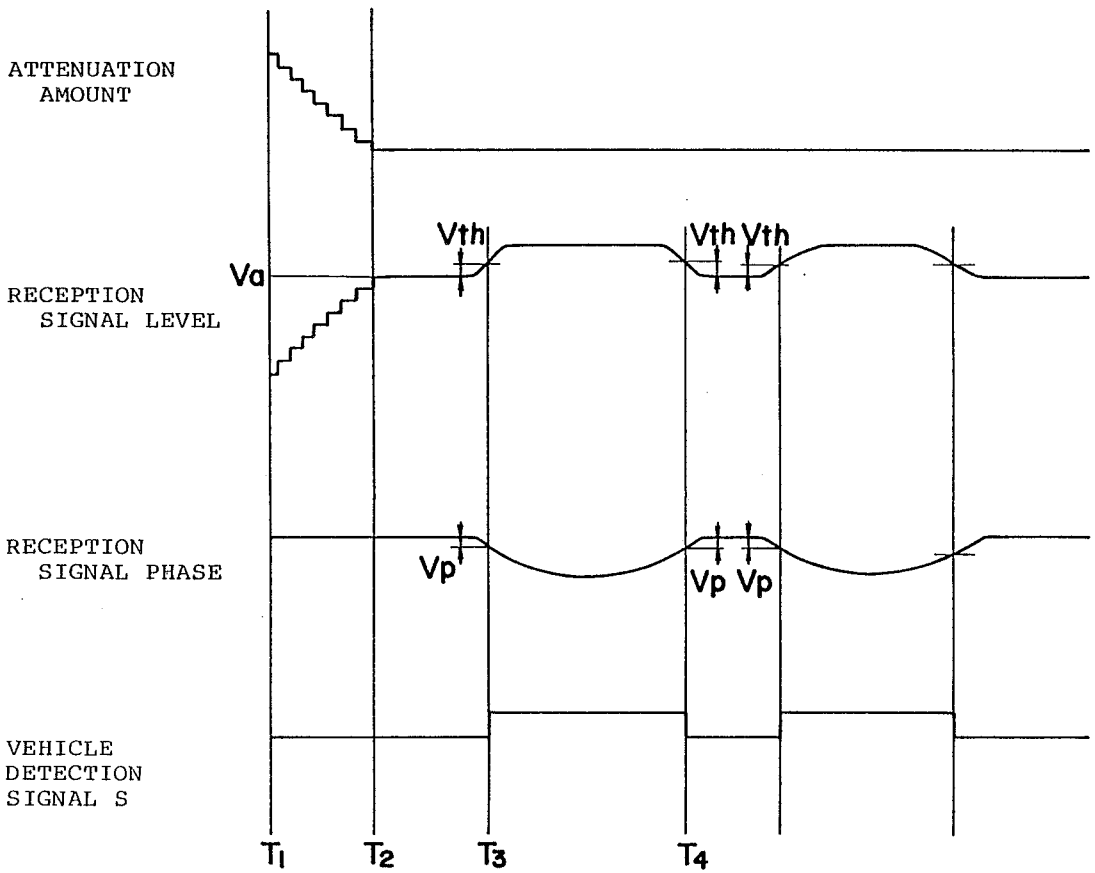
FIG. 12 is a time chart showing the time-dependent changes of the signals, data, and values in the system shown in FIG. 10.

FIG. 10 shows an electrical arrangement of the vehicle detecting system in the case where the transmitting coil 2 and receiving coil 4 arranged as explained above are used. FIG. 11 is a flowchart showing the processing procedure by the CPU. FIG. 12 shows the states of changes of signals, data, and values.

According to the experiments, performed by the inventors of this application, it has been found that when the vehicle C passes the area between the transmitting coil 2 and the receiving coil 4, the phase of the received signal is delayed more than the phase of the transmitting signal, and when the vehicle passes the roadway adjacent to the roadway 1, the phase of the received signal is advanced greater than the phase of the transmitting signal.

Therefore, as well be explained hereinafter, a phase comparator (a phase detector) 36 is provided and the shifting direction of the phase of the received signal is discriminated. Therefore, it is possible to clearly distinguish whether the vehicle has passed the roadway having the vehicle detection area or it has passed the roadway adjacent thereto. Thus, only the vehicles which have passed the detection area can be accurately detected.

In FIG. 10, the same parts and components as those shown in FIG. 5 are designated by the same reference numerals. The vehicle detecting circuit 5 is newly provided with the phase comparator 36. The transmitting signal which is supplied to the transmitting coil 2 and the received signal which is obtained from the receiving coil 4 are inputted to the phase comparator 36. A signal indicative of the phase difference between those signals, more accurately speaking, a signal representative of an amount of phase shift of the received signal using the transmitting signal as the reference is outputted from the comparator 36. The signal indicative of the phase difference is converted into a digital value by an analog-to-digital (A/D) converter 37 and thereafter it is supplied to the microprocessor 21. A threshold value Vp of the phase difference to decide the vehicle detection is set in the RAM 24.

In FIG. 11, the same processes as those shown in FIG. 6 are designated by the same reference numerals. Although the process in steps 101 to 104 in FIG. 6 is omitted from FIG. 11, this process is also similarly executed in the flowchart of FIG. 11. In addition, the updating process of the reception level data (the data which is obtained from the A/D converter 29) in step 111 is omitted in FIG. 11.

Referring now to FIGS. 10 to 12, after completion of the reading and storing operations of the reception level data (step 105 and 106), the phase data of the receiving signal which is obtained from the A/D converter 37 is taken into the microprocessor 21 and stored into a predetermined area of the RAM 24 (steps 121 and 122).

When it is confirmed that the change amount of the reception level data has exceeded the threshold value Vth (step 110), an amount of change in the phase data is likewise derived (steps 123 and 124). A check is then made to see if the change amount (difference) has exceeded the threshold value Vp in the negative direction or not (step 125). If YES, the vehicle detection signal S is outputted (step 113).

In the case of stopping the generation of the detection signal S as well (step 117), the AND logic receives the signal indicating that the change amount of the level of the received signal dropped below the threshold value Vth (steps 115 and 116) and the signal indicating the dropping of the change amount of the phase difference below the threshold value Vp (in steps 126 to 128).

The detecting circuit 13, A/D converter 29, and interface 26 may be omitted and the vehicle detection may be executed on the basis of only the phase difference of the received signal to the transmitting signal as well.

Figure 13:
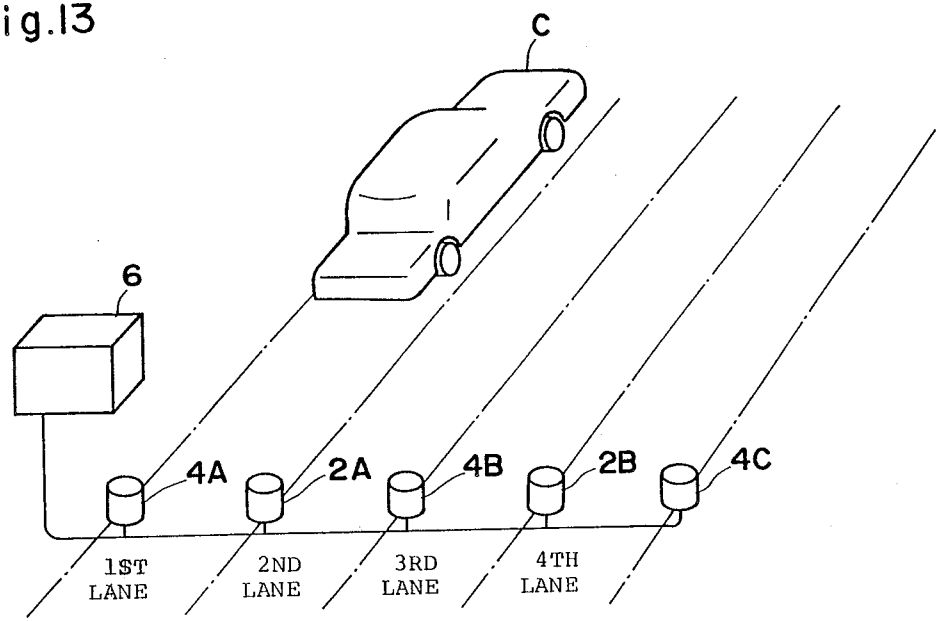
FIG. 13 shows an embodiment in which a plurality of transmitting and receiving coils are alternately arranged.
Figure 14:
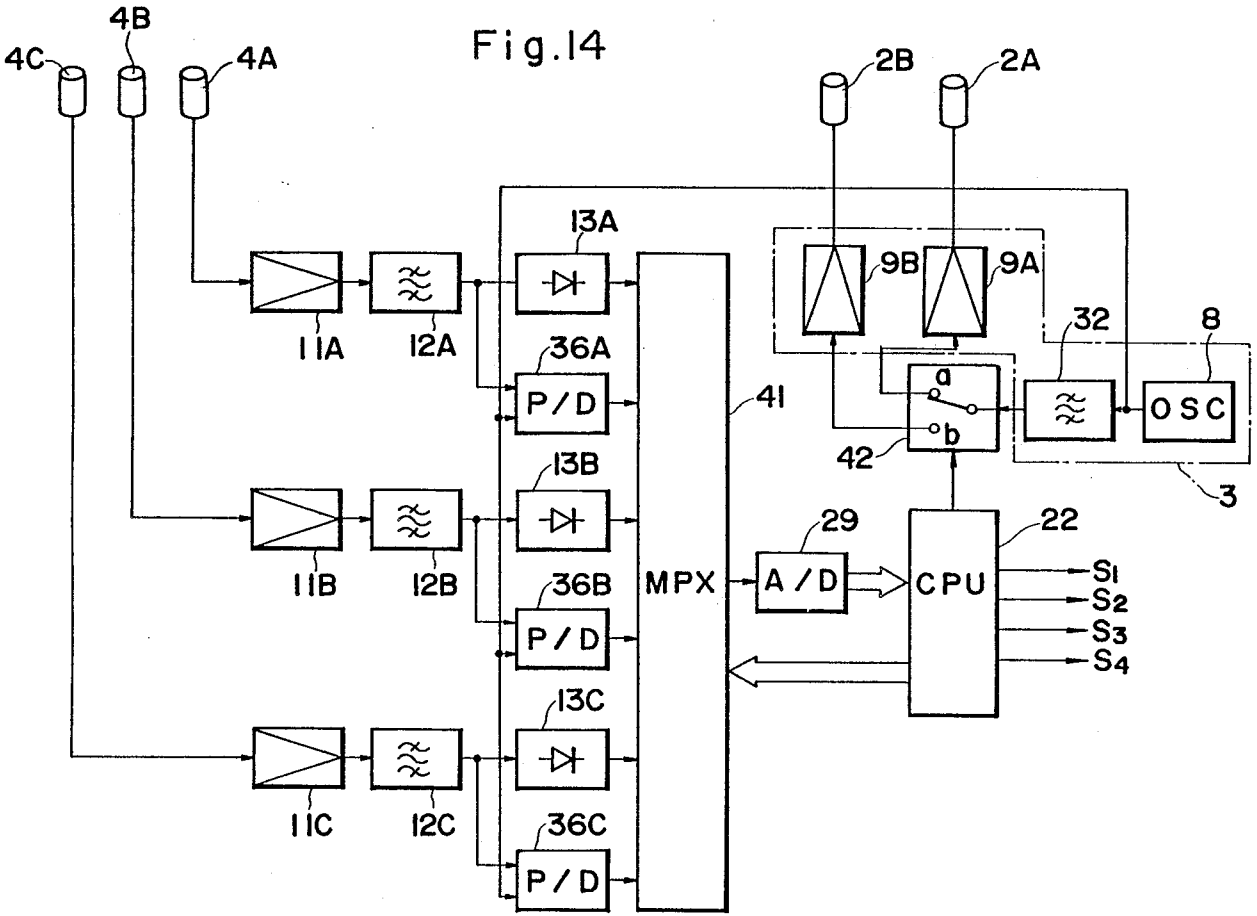
FIG. 14 is a block diagram showing an electrical arrangement of a vehicle detecting system which is applied to the arrangement of the transmitting and receiving coils shown in FIG. 13.

FIGS. 13 and 14 relate to a developed system of the form shown in FIG. 8 and show a system to detect the vehicles which run a plurality of adjacent roadways, for example, a plurality of lanes.

In this embodiment, the example of four lanes is shown. Receiving coils 4A, 4B, and 4C and transmitting coils 2A and 2B are alternately arranged at the boundary portions of the respective lanes in the lateral directon of the lanes.

A high frequency signal which is generated from the oscillator 8 of the driving circuit 3 is sent to a change-over switch 42. Amplifiers 9A and 9B to drive the transmitting coils 2A and 2B are connected to two output sides a and b of the switch 42, respectively. Although the contact type change-over switch 42 has been shown, a contactless type switch composed of transistors and the like may be generally used. The switch 42 is controlled by the CPU 22.

The receiving coils 4A, 4B, 4C are provided with amplifiers 11A, 11B, 11C and band pass filters 12A, 12B, and 12C, respectively. An output of the filter 12A is supplied to a detecting circuit 13A and a phase comparator 36A. Similarly, outputs of the filters 12B and 12C are supplied to detecting circuits 13B and 13C and to phase comparators 36B and 36C, respectively. Outputs of the detecting circuits 13A to 13C and outputs of phase comparators 36A to 36C are all supplied to a multiplexer 41 which is controlled by the CPU 22. These analog outputs are sequentially switched and converted into the digital signals by the A/D converter 29 and thereafter inputted to the CPU 22. Vehicle detection signals $S_1$ to $S_4$ of the first to fourth lanes are individually outputted from the CPU 22.

The above-mentioned system operates in a manner as follows. First, the switch 42 is connected to the side a and the transmitting coil 2A is driven. In this case, the vehicles which pass the first and second lanes can be detected, so that the received signals of the receiving coils 4A and 4B are checked. The output of the detecting circuit 13A is first taken into the CPU 22 through the multiplexer 41 and subsequently the output of the phase comparator 36A is taken into the CPU 22. The process shown in FIG. 11, particularly, the process in steps 108 to 117 is executed by the CPU 22. If it is determined that the passage of the vehicle was detected, the vehicle detecting signal $S_1$ is outputted.

Next, the outputs of the detecting circuit 13B and phase comparator 36B are sequentialy taken into the CPU 22 and the presence or absence of the vehicle in the second lane is decided by the similar process.

Thereafter, the switch 42 is connected to the side b and the transmitting coil 2B is driven. In this case, the vehicle detecting processes for the third and fourth lanes are sequentially performed by checking the signals of the receiving coils 4B and 4C.

By repeatedly executing the above-mentioned processes at a short period, the vehicles in four lanes can be always detected.

Such an alternate arrangement of a plurality of transmitting and receiving coils may be installed in the running direction of the vehicle. With this arrangement, the running velocity of the vehicle can be measured using the different times that the vehicle is detected at respective positions. This arrangement can be also applied to detect a backup of vehicles.

FIGS. 15 to 20 show further other embodiments. These embodiments relate to the systems which are useful to detect the jam of vehicles on the road, waiting states of vehicles at a toll station, running velocities of vehicles, and the like.

Figure 15:
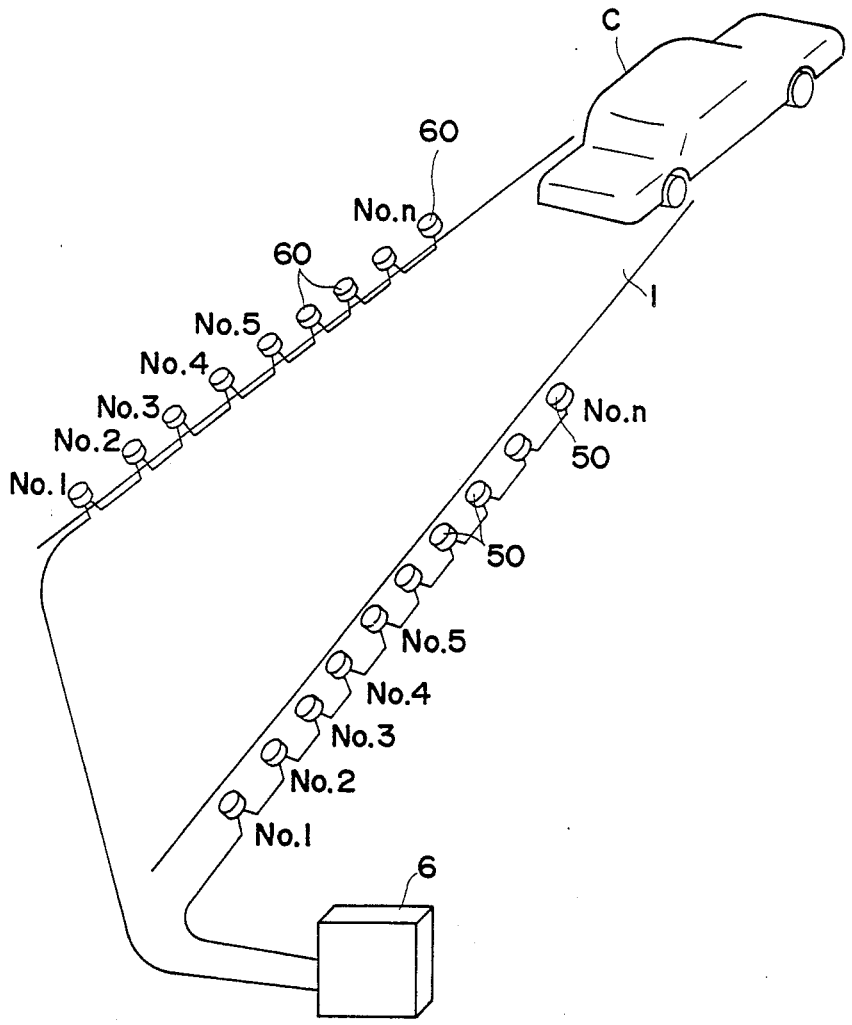

Referring now to FIG. 15, a plurality of transmitters 50 are arranged at regular intervals on one side along the road. A plurality of receivers 60 are arranged at regular intervals on the other side along the road in corresopondence to the transmitters 50, respectively. For convenience of explanation, reference numbers one to n (Nos. 1 to n) are added to the transmitters 50. The same reference numbers (Nos. 1 to n) are also added to the receivers 60 corresponding to the transmitters 50, respectively. These plurality of transmitters 50 are connected in a multidrop manner through one transmitting signal line, a plurality of (for example, in the case of four bits, four) designation signal lines and power supply lines to the box 6 equipped with the vehicle detecting system. These plurality of receivers 60 are also likewise connected to the box 6 in a multidrop manner through one received signal line, a plurality of designation signal lines and power supply lines.

The interval of the transmitters 50 (and receivers 60) is set to 30 to 150 m in the case where, for example, a backup of vehicles is detected at the entrance and exit of an express highway or on another ordinary road. This interval is set to a small value of 0.5 to 1.0 m in the case of detecting the waiting state of vehicles at a toll station or parking lot. Namely, it may be set to a proper desired interval in accordance with practical use requirement.

Figure 16:
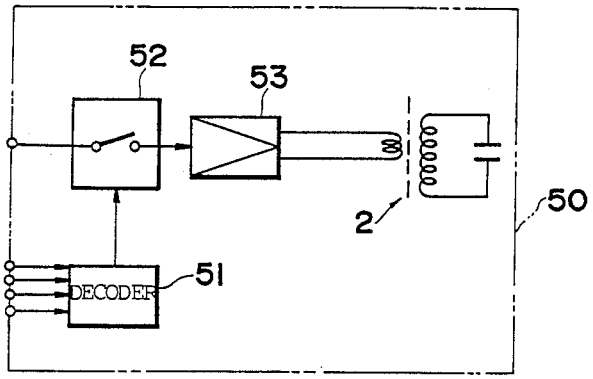

FIG. 16 shows an example of a constitution of the transmitter 50. Apparently, the transmitter 50 includes the transmitting coil 2. The coil 2 is constituted by a resonance circuit on the secondary side and a primary coil to excite the resonance circuit. The high frequency signal transmitted through the transmitting signal line is inputted to an amplifier 53 through a switch 52 consisting of a semiconductor switching device or the like and the transmitting coil 2 is driven by the amplifier 53. For instance, the designation signal of four bits is decoded by a decoder 51 and when this transmitter is designated, the switch 52 is turned on.

Figure 17:
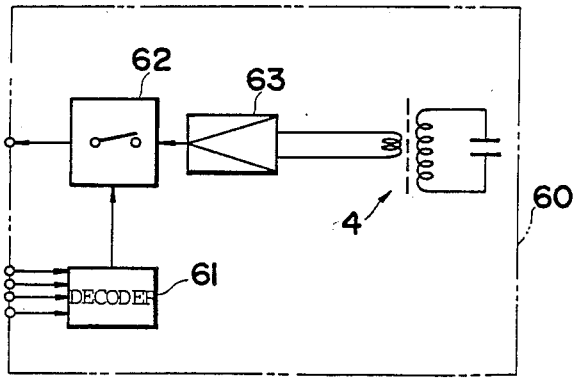

In FIG. 17, the receiver 60 similarly comprises: the receiving coil 4; an amplifier 63 to amplify the received signal of the coil 4; a switch 62 to connect an output of the amplifier 63 to the received signal line; and a decoder 61 to decode the designation signal and turn on the switch 62 when this receiver is designated.

Figure 18:
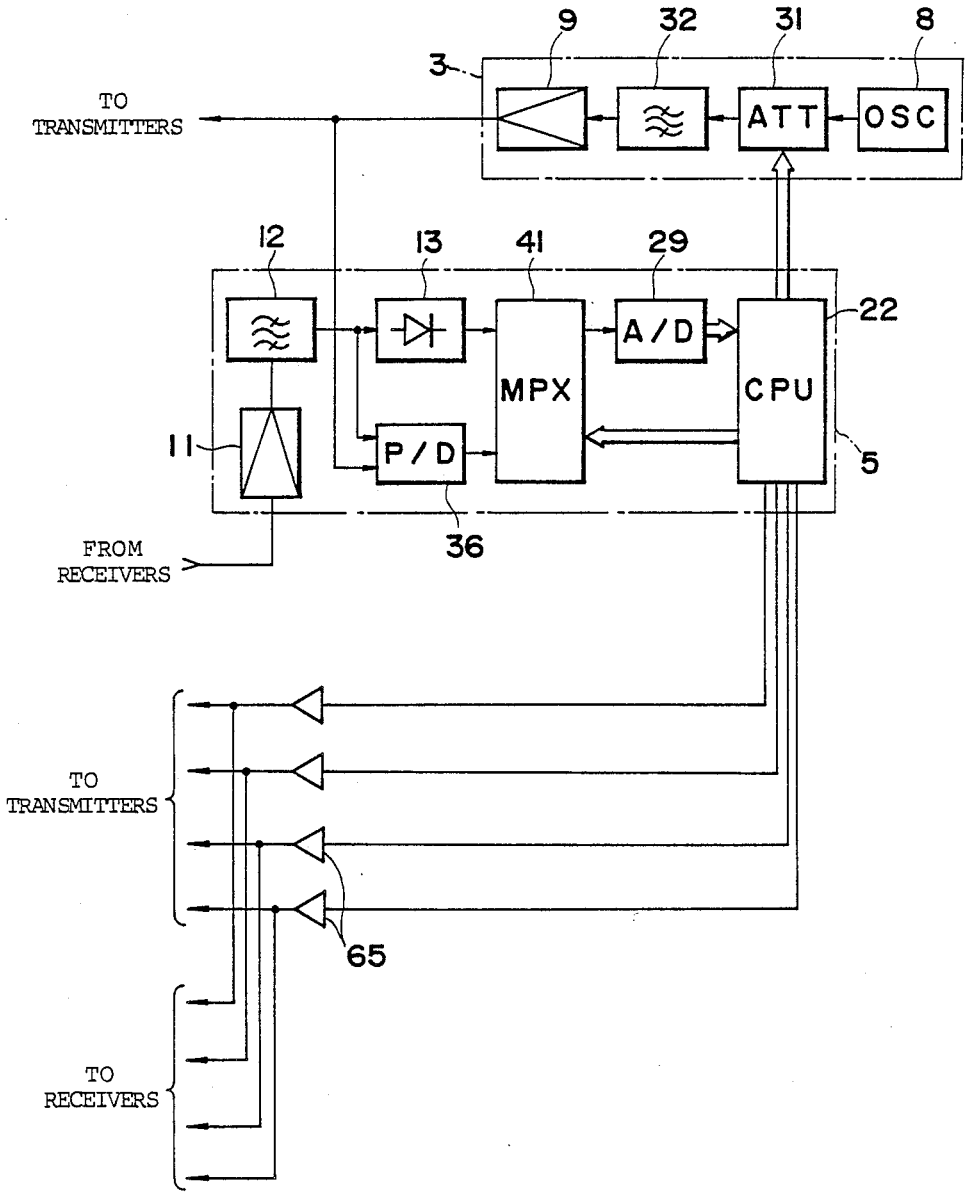

FIG. 18 shows an electrical arrangement of the system built in the box 6. In FIG. 18, the same parts and components as those shown in the block diagram already described in the foregoing embodiments are designated by the same reference numerals. The output of the driving circuit 3 is sent to the transmitting signal line. The received signal line is connected to the amplifier 11 The designation signal lines of four bits extend from the CPU 22 through an interface (not shown). The designation signals on these lines are amplified by an amplifier 65 and thereafter supplied to all of the transmitters 50 and receivers 60. When a pair of transmitter and receiver are designated, the multiplexer 41 sequentially switches the level detection signal and phase difference signal of the received signal from the receiver and supplies them to the CPU 22.

Figure 19:
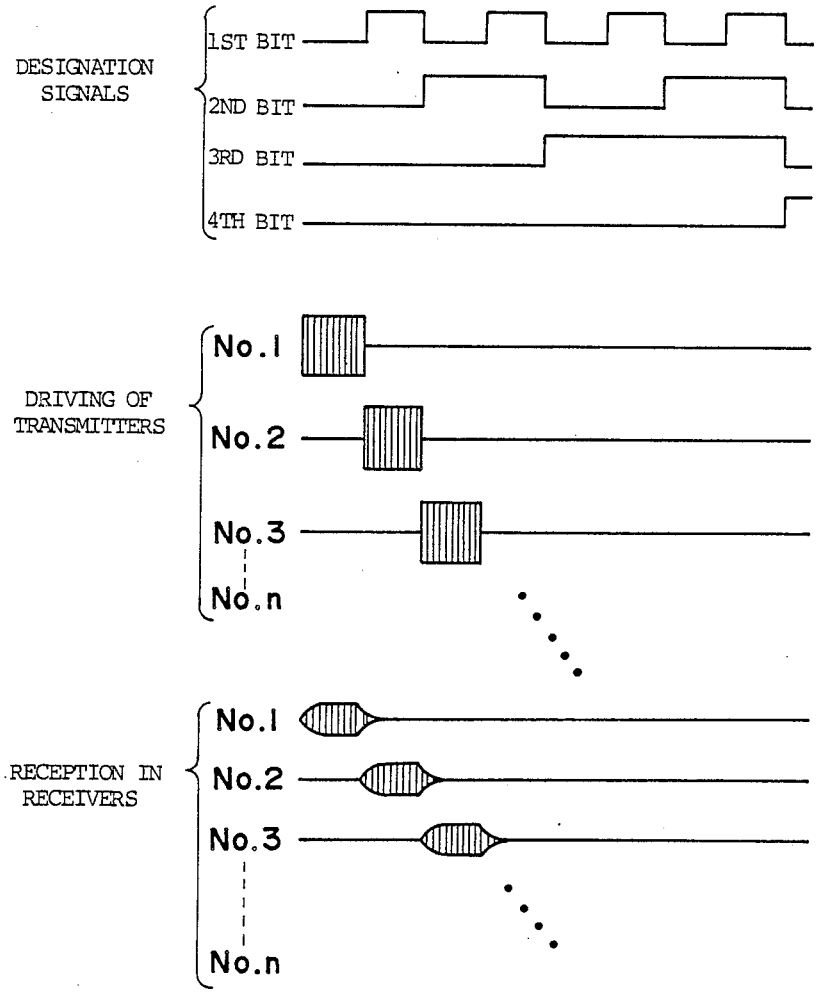

As shown in FIG. 19, each pair of transmitter and receiver is sequentially designated from No. 1 by the designation signal at every constant period of time (e.g., 8 msec). In the designated transmitter 50, the switch 52 is turned on by the decoder 51, so that the transmitting coil 2 is driven for only the designated time period. In the designated receiver 60, on one hand, the received signal of the receiving coil 4 is likewise sent to the vehicle detecting system through the received signal line for only the designated time period. In the system shown in FIG. 18, particularly, the CPU 22 processes the received signals which are sequentially inputted, due to the foregoing method shown in FIG. 11 and the like, thereby determining the detection of the vehicle.

In this manner, a plurality of pairs of transmitters and receivers are time-sharingly driven and the detection of the vehicle in the detection area of each pair of transmitter and receiver is executed.

Figure 20:
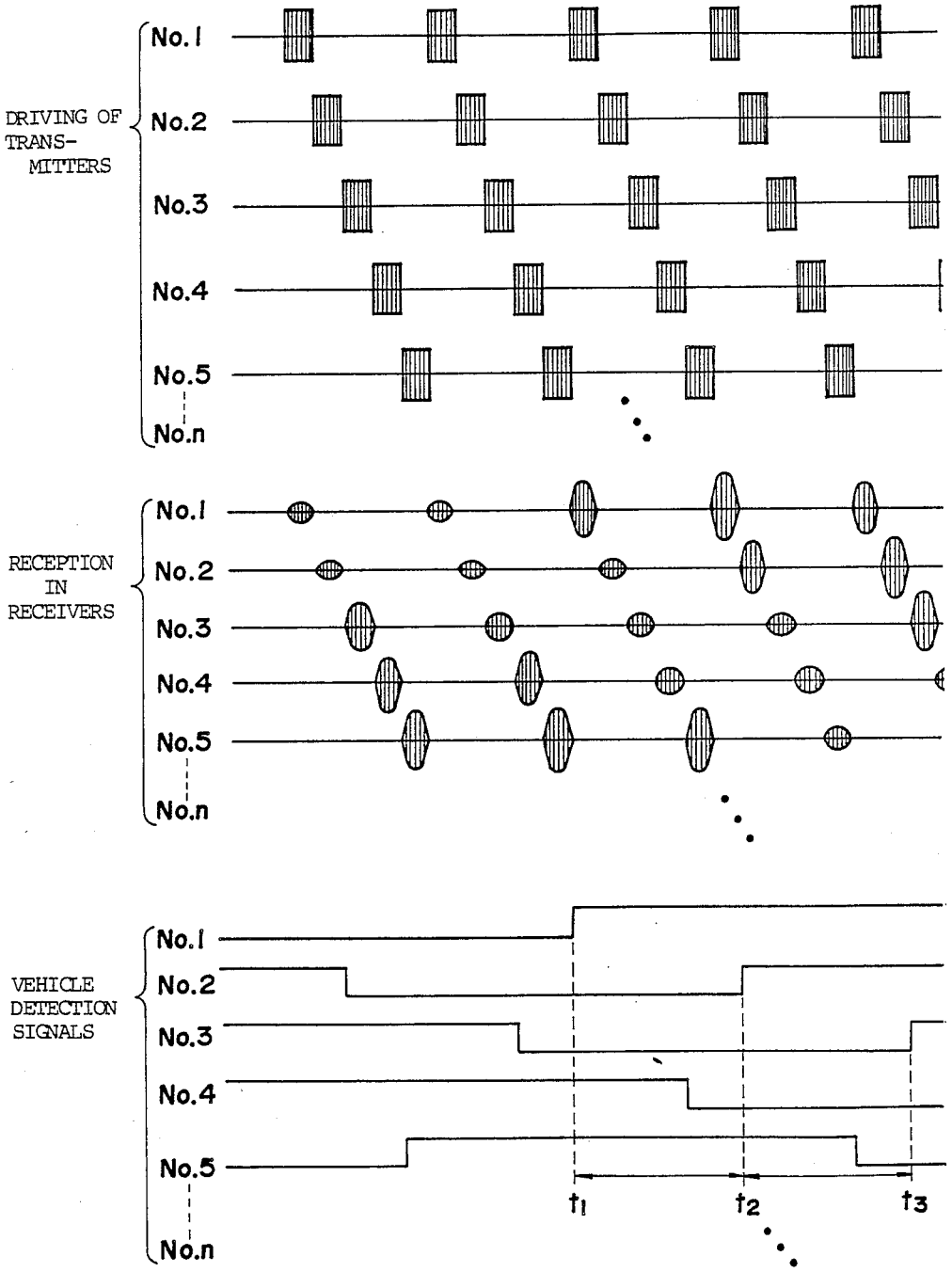

FIG. 20 shows an example of the vehicle detection signals in the respective detection areas. The CPU 22 determines the velocity of the vehicle C and the stop state of the vehicle C on the basis of the time-dependent changes of the vehicle detection signals. The difference of times when the detection of the existence of the vehicle C is started between the adjacent receivers is obtained. For example, the time difference between time $t_1$ when the detection of the existence of the vehicle C by the No. 1 receiver is started and time $t_2$ when the detection of the existence of the vehicle C by the No. 2 receiver is started, namely, $(t_2 - t_1)$ is calculated. Or, the time difference of the vehicle detection between the Nos. 2 and 3 receivers, namely, $(t_3 - t_2)$ is calculated. The running velocity of the vehicle C can be calculated by dividing the resultant time difference by the interval between the adjacent receivers installed. The running velocity obtained is compared with a set value. When it is larger than the set value, it is decided that the vehicle C smoothly runs. If the velocity is smaller than the set value, on the contrary, it is determined that the vehicle C is involved in a backup.

In the above embodiment, each of the transmitters and receivers is provided with the switch and decoder. However, if the transmitters (or receivers) are installed at large regular intervals in the running direction of the vehicle and the transmitters (or receivers) are not adversely influenced by the adjacent transmitting coils or receiving coils, the switch and decoder may be provided for only either one of the transmitter and receiver.

What is claimed is:

1. A vehicle detecting system comprising:

a plurality of transmitters each including a transmitting coil means, a first switching means and a first decoder means, said transmitters being arranged at regular intervals on one side along a vehicle roadway near a predetermined detection area of said roadway;

a plurality of receivers each including a receiving coil means, a second switching means and a second decoder means, said receivers being arranged on the other side of the vehicle roadway at positions corresponding to said plurality of transmitters;

generating means for generating a designation signal to designate a pair formed of one of said transmitters and one of said receivers;

a driving circuit for supplying a high frequency exciting output current to said plurality of transmitters;

vehicle detecting means for outputting a vehicle detection signal in response to a change exceeding a predetermined amount of the characteristic of an input signal from one of said receiving coil means; and wherein each of said first decoder means comprises means, responsive to being designated by said designation signal, for turning a corresponding first switching means on to supply the outputs of said driving circuit to a corresponding transmitting coil means and each of said second decoder means comprises means, responsive to being designated by said designation signal, for turning a corresponding second switching means on to supply the received signal of a corresponding receiving coil means as said input signal to said vehicle detecting means.

2. The system as in claim 1, wherein said high frequency exciting current induces an electrical signal of non-zero level in said receiving coil means of the plurality of transmitters when no vehicle is present in said detection area.

3. The system as in claim 2, wherein said vehicle detecting means includes a comparator for comparing the level of said electrical signal induced in the receiving coil means with a predetermined reference level.

4. The system as in claim 2, further comprising means for controlling a level of the exciting current which is supplied from said driving circuit to said transmitting coil means in order to maintain the level of said electrical signal induced in said receiving coil means substantially constant when no vehicle is present in said detection area.

5. The system as in claim 2, wherein said transmitting coil means and said receiving coil means are buried under the surface of the roadway.

6. The system as in claim 2, wherein said transmitting coil means and said receiving coil means are disposed on the roadway.

7. The system as in claim 2, wherein said vehicle detection means comprises means for periodically sampling at a specific time interval a level of said electrical signal induced in said receiving coil means to determine an amount of change in a predetermined characteristic of the electrical signal, for comparing said amount of change with a predetermined reference value, and for outputting a vehicle detection signal when said amount of change exceeds said predetermined reference value.

8. The system as in claim 7, wherein the predetermined characteristic of said electrical signal is a level of the signal and said vehicle detecting means outputs the vehicle detection signal when a change in the level of said signal induced in said receiving coil means exceeds a predetermined value.

9. The system as in claim 7, wherein the predetermined characteristic of said electrical signal is a phase of the signal and said vehicle detecting means outputs the vehicle detection signal when a change in the phase of said signal induced in the receiving coil means exceeds a predetermined angle.

10. The system as in claim 7, further comprising means for controlling a level of the exciting current which is supplied from said driving circuit to said transmitting coil means in order to maintain the level of said electrical signal induced in said receiving coil means substantially constant when no vehicle is present in said detection area.

* * * * *

UNITED STATES PATENT AND TRADEMARK OFFICE

CERTIFICATE OF CORRECTION

PATENT NO. : 4,968,979

DATED : November 6, 1990

INVENTOR(S) : Masao MIZUNO, et al.

It is certified that error appears in the above-identified patent and that said Letters Patent is hereby corrected as shown below:

On the title page,

Item [30] FOREIGN APPLICATION PRIORITY DATA

Change "Apr. 19, 1986" to --Apr. 19, 1985--.

Signed and Sealed this

Eighteenth Day of June, 1991

*Attest:*

*Attesting Officer*

HARRY F. MANBECK, JR.

*Commissioner of Patents and Trademarks*